US009997834B1

(12) United States Patent
Miura et al.

(10) Patent No.: US 9,997,834 B1
(45) Date of Patent: Jun. 12, 2018

(54) ANTENNA DEVICE AND COMMUNICATION TERMINAL APPARATUS

(71) Applicant: Murata Manufacturing Co., Ltd., Nagaokakyo-shi, Kyoto-fu (JP)

(72) Inventors: Teppei Miura, Nagaokakyo (JP); Nobuo Ikemoto, Nagaokakyo (JP); Jun Sasaki, Nagaokakyo (JP); Noboru Kato, Nagaokakyo (JP); Nobuhito Tsubaki, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days. days.

(21) Appl. No.: 15/878,554

(22) Filed: Jan. 24, 2018

Related U.S. Application Data

(63) Continuation of application No. 13/599,108, filed on Aug. 30, 2012, now Pat. No. 9,917,366, which is a (Continued)

(30) Foreign Application Priority Data

Feb. 15, 2011 (JP) ..... 2011-029315

(51) Int. Cl.
*H01Q 7/06* (2006.01)
*H01Q 1/24* (2006.01)
(Continued)

(52) U.S. Cl.
CPC ..... *H01Q 7/06* (2013.01); *H01Q 1/2283* (2013.01); *H01Q 1/243* (2013.01); *H01Q 1/40* (2013.01); *H01Q 7/08* (2013.01); *H01Q 9/27* (2013.01)

(58) Field of Classification Search
CPC ..... H01Q 1/2283; H01Q 7/06; H01Q 7/08
See application file for complete search history.

(56) References Cited

U.S. PATENT DOCUMENTS 7,050,007 B2 * 5/2006 Akiho ..... G06K 7/0008 343/702
9,865,924 B2 * 1/2018 Miura ..... H01Q 7/08
(Continued)

FOREIGN PATENT DOCUMENTS

GB 2469209 A * 10/2010 ..... G06K 19/07749
WO WO 2010122888 A1 * 10/2010 ..... H01Q 1/38

OTHER PUBLICATIONS

Miura et al., "Antenna Device and Communication Terminal Apparatus", U.S. Appl. No. 13/599,108, filed Aug. 30, 2012.

*Primary Examiner* — Jessica Han
*Assistant Examiner* — Amal Patel
(74) *Attorney, Agent, or Firm* — Keating & Bennett, LLP

(57) ABSTRACT

An antenna device includes a base including a planar conductor disposed thereon, and a coil antenna. The coil antenna includes a coil conductor wound around a magnetic core. The coil antenna is arranged such that a coil opening of the coil conductor is closed to an edge of the planar conductor. A current passing through the coil conductor induces a current in the planar conductor. Thus, a first magnetic flux occurs in the coil antenna, and a second magnetic flux occurs in the planar conductor. Therefore, a third magnetic flux occurs in an area of the planar conductor. Accordingly, the antenna device achieves a small footprint, a small-sized communication terminal apparatus and a desired communication distance.

5 Claims, 11 Drawing Sheets

Related U.S. Application Data continuation of application No. PCT/JP2012/052217, filed on Feb. 1, 2012.

(51) Int. Cl.

| | |
|---|---|
| ***H01Q 7/08*** | (2006.01) |
| ***H01Q 9/27*** | (2006.01) |
| ***H01Q 1/40*** | (2006.01) |
| ***H01Q 1/22*** | (2006.01) |

(56) References Cited

U.S. PATENT DOCUMENTS

| | | | | |
|---|---|---|---|---|
| 9,917,366 | B2 * | 3/2018 | Miura | H01Q 7/06 |
| 2005/0162331 | A1 * | 7/2005 | Endo | G06K 7/10336 343/788 |
| 2009/0065594 | A1 * | 3/2009 | Kato | G06K 19/07749 235/492 |
| 2012/0091821 | A1 * | 4/2012 | Kato | H01Q 1/38 307/104 |

* cited by examiner

ANTENNA DEVICE AND COMMUNICATION TERMINAL APPARATUS

BACKGROUND OF THE INVENTION

1. Field of the Invention

The present invention relates to antenna devices and communication terminal apparatuses and, in particular, to an antenna device and communication terminal apparatus preferably for use in a communication system in the high-frequency (HF) range.

2. Description of the Related Art

A radio-frequency identification (RFID) system for exchanging information between a reader-writer and an RFID tag by non-contact communications between the reader-writer and the RFID tag and a near field communication (NFC) system for carrying out communications between two communication apparatuses at a short range are known. An RFID system and a near field communication system that use the HF range, for example, a 13.56 MHz range, as the communication frequency employ antennas coupled to each other mainly through an induction field.

In recent years, some communication terminal apparatuses, such as cellular phones, have introduced an RFID system or a near field communication system, and the communication terminal apparatuses have been used as an RFID tag and a reader-writer used therefor or been used as terminals in near field communication. A magnetic antenna is known as an antenna device for use in transmitting and receiving a radio-frequency signal in the HF range. The magnetic antenna has a structure in which a coil conductor is wound around the surface of a magnetic core, as described in, for example, Japanese Unexamined Patent Application Publication No. 2005-317674 and Japanese Unexamined Patent Application Publication No. 2007-019891.

FIG. 1 is an exploded perspective view of a magnetic antenna in Japanese Unexamined Patent Application Publication No. 2007-019891. The magnetic antenna is a laminate that includes a plurality of magnetic layers 5 in which a coil 4 made up of electrode layers 2 and through holes 1 is disposed, insulating layers 6 sandwiching the upper and lower surfaces of the coil 4, and a conductive layer 7 disposed on the upper surface of one or more of the insulating layers.

In a system that uses the HF range as the communication frequency, the communication distance between the antenna devices depends on magnetic flux passing through the coil antennas. That is, to ensure some communication distance between the antenna devices, it is necessary for each of the coil antennas to have a large size. The large size of the coil antenna hinders miniaturization of the communication terminal apparatus. In contrast, if the antenna is small, the effective area of the antenna is small and the communication distance is not sufficient.

SUMMARY OF THE INVENTION

In light of the above-described circumstances, preferred embodiments of the present invention provide an antenna device having a small footprint and a small-sized communication terminal apparatus while a predetermined communication distance is ensured.

An antenna device according to a preferred embodiment of the present invention includes a coil antenna and a booster antenna. The coil antenna includes a coil conductor wound around a winding axis and a magnetic body arranged at least inside a winding region of the coil conductor, the coil antenna being mounted such that a mounting surface thereof is a conductor aperture plane, the conductor aperture plane being a plane through which the winding axis passes. The booster antenna includes a planar conductor functioning as a booster coupled to the coil antenna through an electromagnetic field. A portion of the coil conductor and an edge of the planar conductor overlap each other at least partially when seen in plan view in a direction of the winding axis.

A communication terminal apparatus according to a preferred embodiment of the present invention includes an antenna device and a communication circuit. The antenna device includes a coil antenna and a booster antenna, the coil antenna including a coil conductor wound around a winding axis and a magnetic body arranged at least inside a winding region of the coil conductor, the coil antenna being mounted such that a mounting surface thereof is a conductor aperture plane, the conductor aperture plane being a plane through which the winding axis passes, the booster antenna including a planar conductor functioning as a booster coupled to the coil antenna through an electromagnetic field. A portion of the coil conductor and an edge of the planar conductor overlap each other at least partially when seen in plan view in a direction of the winding axis. The communication circuit is connected to the antenna device.

The antenna device according to a preferred embodiment of the present invention includes the coil antenna and the planar conductor. Accordingly, the antenna device having a small footprint while a predetermined communication distance is ensured can be achieved, and the small-sized communication terminal apparatus can also be achieved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Antenna devices and communication terminal apparatuses according to preferred embodiments described below are preferably used in a radio-frequency identification (RFID) system in the HF range, such as a near field communication (NFC) system, for example.

First Preferred Embodiment

Figure 1:
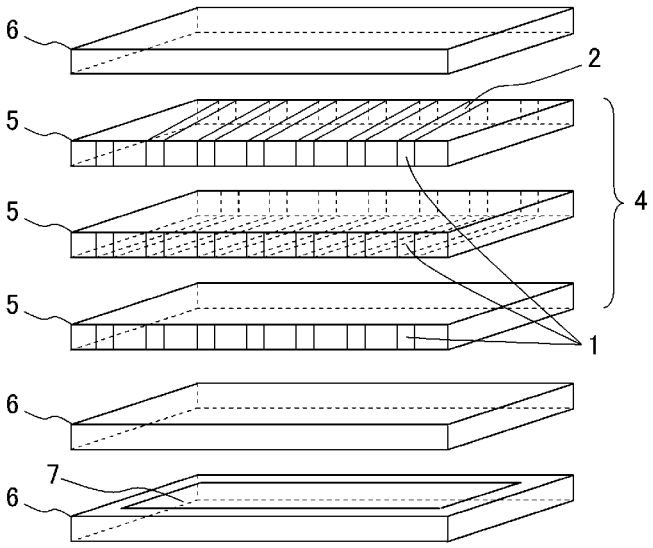
FIG. 1 PRIOR ART
FIG. 1 is an exploded perspective view of a magnetic antenna in Japanese Unexamined Patent Application Publication No. 2007-019891.
Figure 2A:
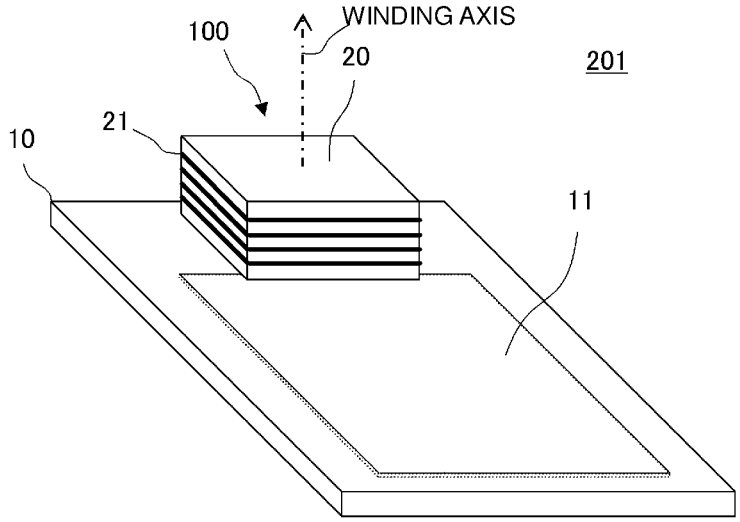
FIG. 2A is a perspective view of an antenna device 201 according to a first preferred embodiment of the present invention.
Figure 2B:
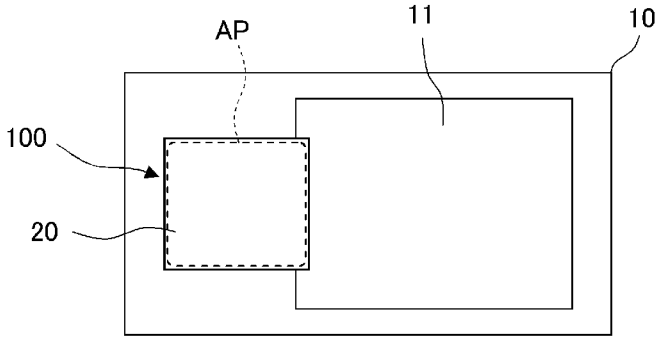
FIG. 2B is a plan view of the antenna device 201.
Figure 2C:
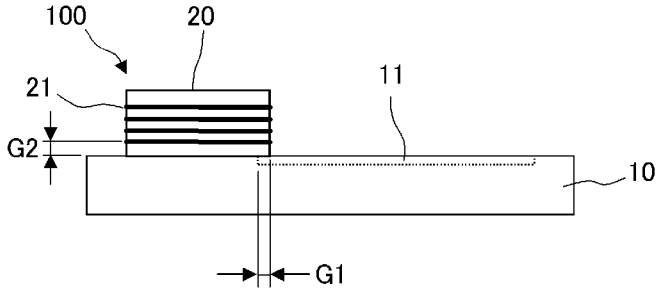
FIG. 2C is a front view of the antenna device 201.

FIG. 2A is a perspective view of an antenna device 201 according to a first preferred embodiment, FIG. 2B is a plan view thereof, and FIG. 2C is a front view thereof.

The antenna device 201 includes a booster antenna including a planar conductor 11 and a coil antenna 100. The coil antenna 100 includes a coil conductor 21 wound around a magnetic core 20.

The coil antenna 100 is surface-mounted on a base 10 including a printed wiring board made of, for example, epoxy resin, such that the mounting surface is a conductor aperture plane AP (see FIG. 2B), the conductor aperture plane AP being a plane through which the winding axis of the coil conductor 21 passes.

Specifically, the coil antenna 100 has a structure in which the coil conductor 21 made of, for example, silver or copper, is wound around the magnetic core 20 made of, for example, ferrite. The coil conductor 21 is wound around four side surfaces (peripheral surfaces) perpendicular or substantially perpendicular to two major surfaces (one of which is the conductor aperture plane AP) of the magnetic core 20 preferably having the shape of a rectangular parallelepiped, for example. That is, the winding axis of the coil conductor 21 extends along the direction perpendicular or substantially perpendicular to the major surfaces of the magnetic core 20.

The magnetic core 20 in the coil antenna 100 includes a ferrite sinter or a resin body in which a ferrite material is distributed in resin. The coil conductor 21 may further be overlaid with a protective film made of an insulating material having low permeability.

The coil antenna 100 is preferably configured as a so-called surface-mounted coil antenna (chip coil antenna). Two mounting terminal electrodes (not illustrated) connected to first and second ends of the coil conductor 21, respectively, are disposed on the back surface of the coil antenna 100. That is, the coil antenna 100 is configured such that it can be surface-mounted on various substrates, including a printed wiring board.

The planar conductor 11 is preferably configured so as to be made of foil of metal, such as copper, silver, or aluminum, and have a rectangular or substantially rectangular shape and is disposed on the surface of the base 10 including a printed wiring board. The base 10 is not limited to a rigid printed wiring board and may be made of flexible resin. The planar shape of the planar conductor is not limited to a rectangular or substantially rectangular shape and can have any shape, such as a circular shape or a diamond shape. The planar conductor is not limited to a planar thin metal film and may be an integral portion of a metal item.

The coil antenna 100 is arranged such that a portion of the coil conductor 21 and an edge of the planar conductor 11 overlap each other when seen in plan view in the direction of the winding axis. In the example illustrated in FIG. 2C, the portion of the coil conductor 21 in the coil antenna 100 extends into the region where the planar conductor 11 is defined by the dimension G1. The outer surface of the planar conductor 11 and the lower end of the coil conductor 21 are separated from each other by the height G2. Smaller dimensions G1 and G2 may be preferable because they lead to a stronger coupling degree between the coil antenna 100 and the booster antenna. As described below, the booster antenna including the planar conductor 11 is coupled to the coil antenna 100 through an electromagnetic field.

Figure 3A:
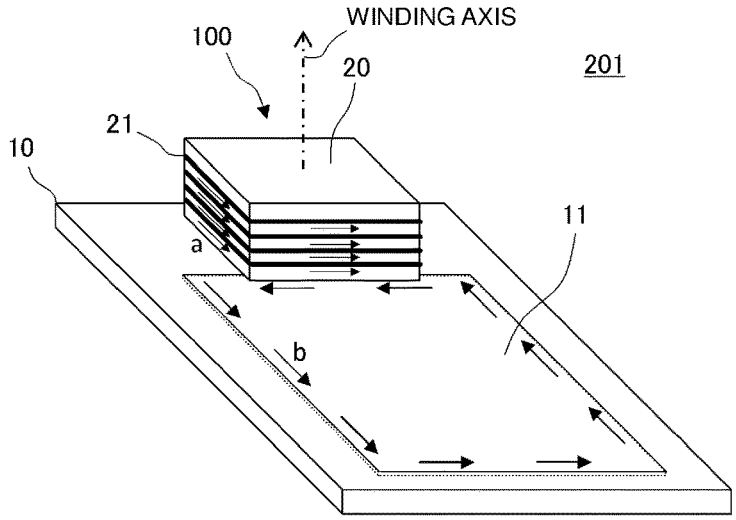
FIG. 3A is a perspective view that illustrates the direction of each of a current passing through a coil conductor of a coil antenna 100 in the antenna device 201, a current passing through a planar conductor 11, a magnetic field resulting from the coil antenna 100, and a magnetic field resulting from the planar conductor 11.
Figure 3B:
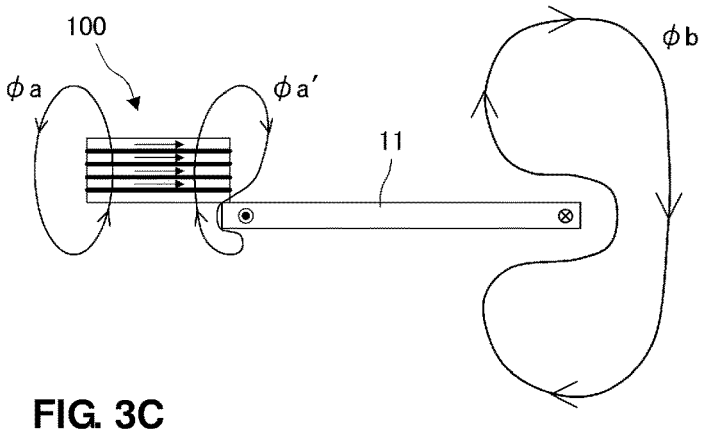
FIGS. 3B and 3C illustrate the relationship between a current passing through the planar conductor 11 and magnetic flux produced by it.
Figure 3C:
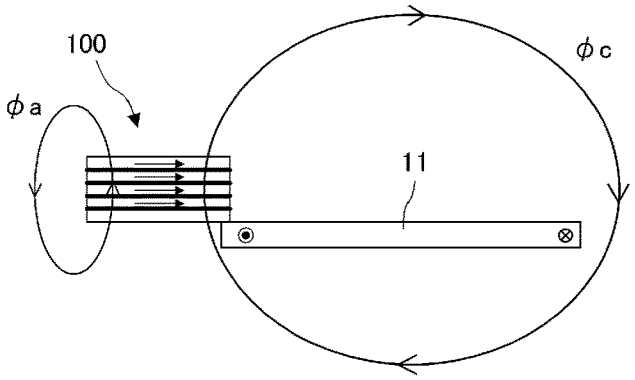

FIG. 3A is a perspective view that illustrates the direction of each of a current passing through the coil conductor 21 of the coil antenna 100 in the antenna device 201 and a current passing through the planar conductor 11. FIGS. 3B and 3C schematically illustrate states of the current passing through the coil conductor 21 of the coil antenna 100, the current passing through the planar conductor 11, and magnetic flux produced by them.

When a current passes through the coil conductor 21 in the direction of the current "a", a current is induced in the planar conductor 11 in the direction of the current "b". That is, the current passing through the coil conductor 21 makes the induced current b circulate in the periphery of the planar conductor. As a result, as illustrated in FIG. 3B, magnetic flux indicated by the arrow $\phi a$ occurs to the coil antenna 100 and magnetic flux indicated by the arrow $\phi b$ occurs to the planar conductor 11. The magnetic flux $\phi a'$ illustrated in FIG. 3B indicates magnetic flux that does not pass through the planar conductor 11.

FIG. 3C depicts the magnetic flux indicated in FIG. 3B more equivalently. The magnetic flux indicated by the arrow $\phi c$ is the one in which the magnetic flux B occurring to the vicinity of the planar conductor 11 and the magnetic flux $\phi a'$ occurring to the coil antenna 100 are combined.

When magnetic flux is received from a coil antenna of a communication partner, the phenomenon opposite to that described above arises. That is, when magnetic flux of the coil antenna of the communication partner flows in the vicinity of the planar conductor 11 and links the coil antenna 100, the current b passes through the planar conductor 11 and the current a passes through the coil conductor 21.

Figure 4A:
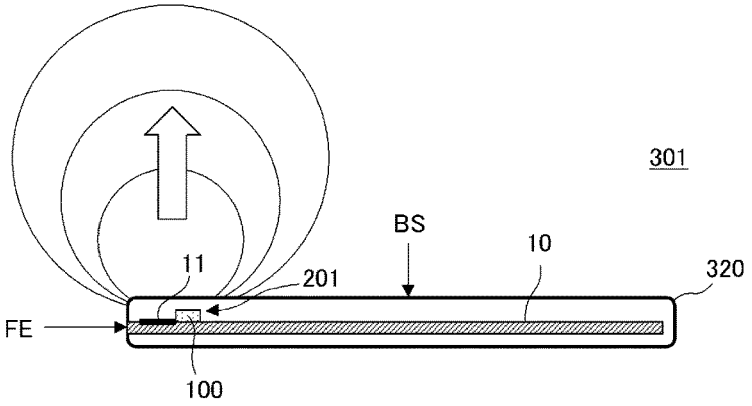
FIG. 4A is a cross-sectional view of a communication terminal apparatus 301 including the antenna device 201.
Figure 4B:
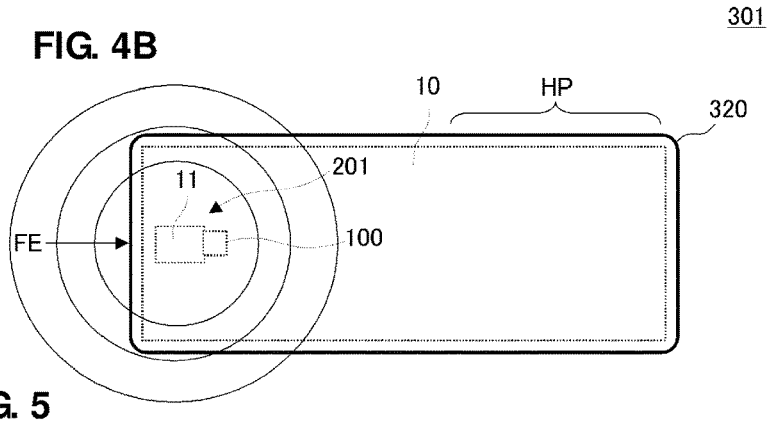
FIG. 4B is a see-through plan view of the communication terminal apparatus 301.

FIG. 4A is a cross-sectional view of a communication terminal apparatus 301 including the antenna device 201, and FIG. 4B is a see-through plan view thereof. The base 10 is a printed wiring board. The planar conductor 11 is disposed on the surface of the base 10. The coil antenna 100 is surface-mounted on the base 10.

As illustrated in FIG. 3C, the magnetic flux resulting from the coil antenna 100 and the magnetic flux resulting from the planar conductor 11 are combined into the large magnetic flux in the direction of the arrow illustrated in FIG. 4A. Therefore, the antenna device 201 has the directivity in the direction of the arrow illustrated in FIG. 4A. That is, the antenna device 201 obtains a high gain in the direction from the vicinity of the front end FE of a terminal casing 320 of the communication terminal apparatus 301 toward the back surface BS. Accordingly, when a user grips the hand-held portion HP of the communication terminal apparatus 301 and holds the front end over the communication partner, communication can be carried out under the high gain.

Second Preferred Embodiment

Figure 5:
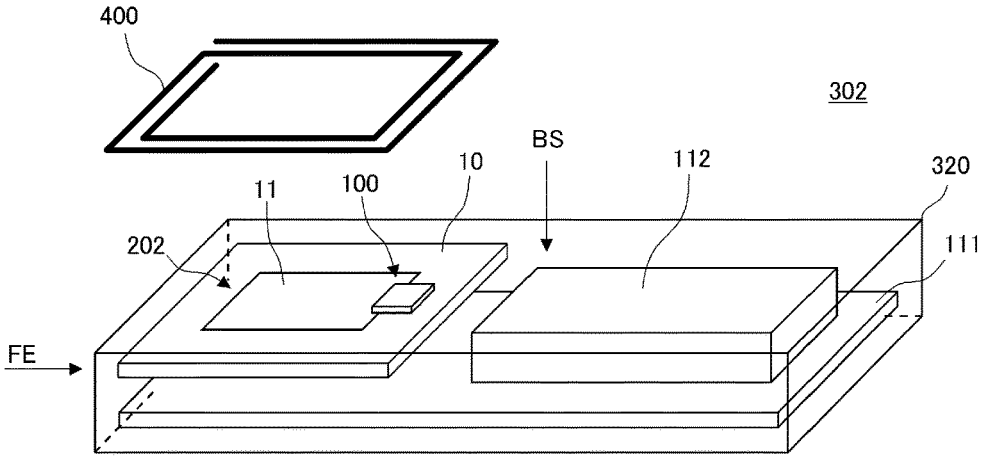
FIG. 5 is a see-through perspective view that illustrates a used state of a communication terminal apparatus according to a second preferred embodiment of the present invention.

FIG. 5 is a see-through perspective view that illustrates a used state of a communication terminal apparatus according to a second preferred embodiment. The communication terminal apparatus 302 can be a cellular phone terminal, for example. The communication terminal apparatus 302 includes a main substrate 111 and the base 10 as a sub-substrate in the terminal casing 320. An antenna device 202 is disposed on the surface of the base 10. The antenna device 202 is arranged on the back surface BS side of the terminal casing 320 together with a battery pack 112. The main substrate 111 is a large printed wiring board including a rigid resin substrate made of, for example, epoxy resin. Circuit elements that define, for example, a circuit that drives a display device and a circuit for controlling the battery are mounted on the main substrate 111. The base 10 as the sub-substrate includes a flexible resin substrate made of, for example, a polyimide or liquid crystal polymer. In addition to the antenna device 202, circuit elements that define a communication circuit (RF circuit) and other circuits are mounted on the base 10. Alternatively, these circuit elements may be mounted on the main substrate 111.

The above-described communication circuit includes, for example, a wireless IC chip and is connected to (receives electricity from) the antenna device 202. The wireless IC chip and the antenna device 202 form RFID.

When the communication terminal apparatus 302 is held over a coil antenna 400, such as a reader-writer, of a communication partner, as illustrated in FIG. 5, the antenna device 202 and the coil antenna 400 of the communication partner are coupled to each other mainly through an induction field and exchange predetermined information, and the communication terminal apparatus 302 functions as RFID.

Third Preferred Embodiment

Figure 6:
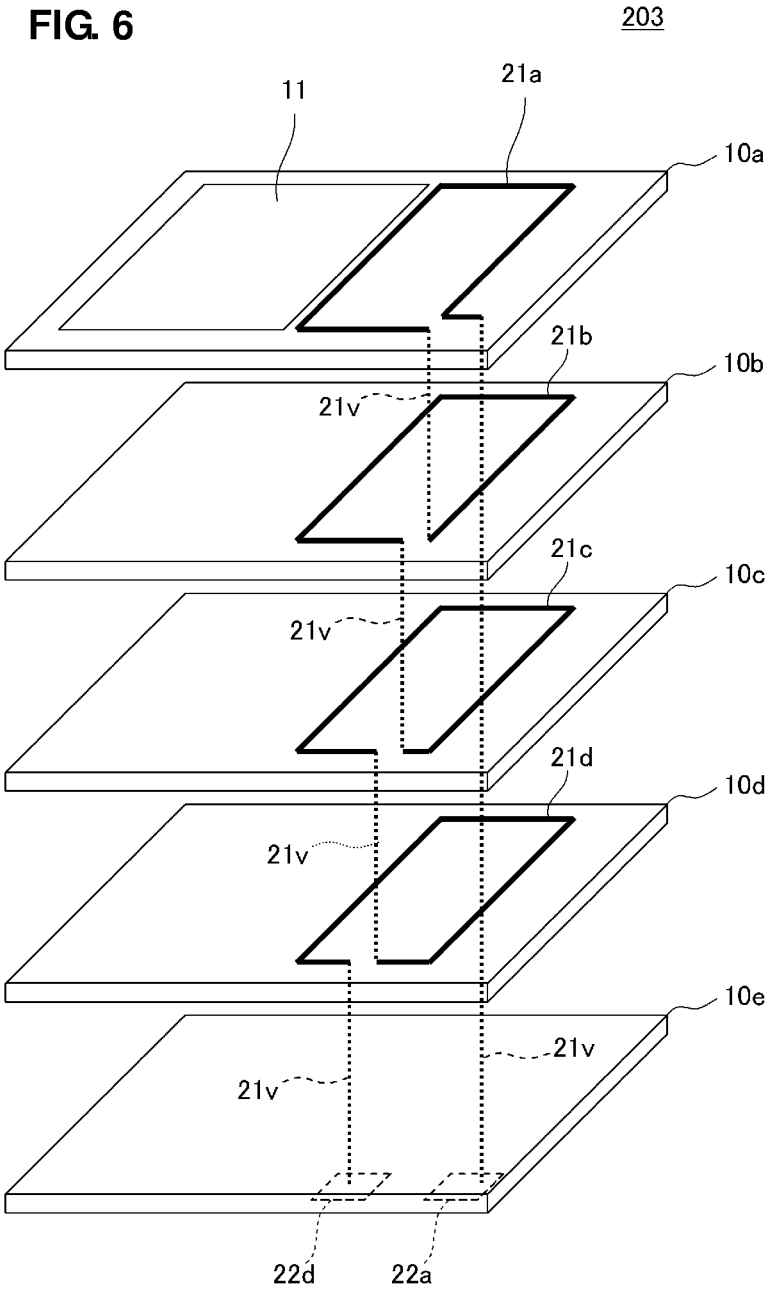
FIG. 6 is an exploded perspective view of an antenna device 203 according to a third preferred embodiment of the present invention.

FIG. 6 is an exploded perspective view of an antenna device 203 according to a third preferred embodiment. The antenna device 203 includes a multilayer substrate in which base layers 10*a*, 10*b*, 10*c*, 10*d*, and 10*e* including a magnetic body are stacked. Loop conductive patterns 21*a* to 21*d* are disposed on the base layers 10*a* to 10*d*, respectively. Input and output terminals 22*a* and 22*d* to be connected to a feeder circuit are disposed on a first major surface of the base layer 10*e*. Via conductors 21*v* are disposed in the base layers 10*a* to 10*e*, and the conductive patterns 21*a* to 21*d* and the via conductors 21*v* define a single coil conductor.

The planar conductor 11 is disposed on a second major surface of the base layer 10*a*. The planar conductor 11 is disposed such that its edge is arranged in close vicinity of the coil opening of the coil conductor. Therefore, the antenna device is configured such that the coil antenna and the planar conductor are integrated in the multilayer substrate.

It is not necessary that all of the base layers 10*a* to 10*e* are magnetic layers. For example, the base layer 10*a* may be a non-magnetic layer. When the base layer 10*a* is a non-magnetic layer, a high degree of coupling between the coil conductor and the planar conductor 11 (booster antenna) is obtainable.

Fourth Preferred Embodiment

Figure 7A:
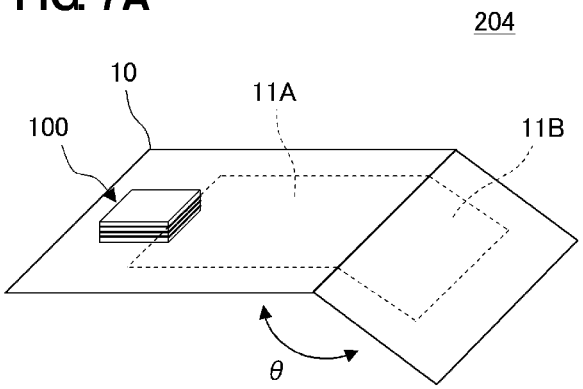
FIG. 7A is a perspective view of an antenna device 204 according to a fourth preferred embodiment of the present invention.
Figure 7B:
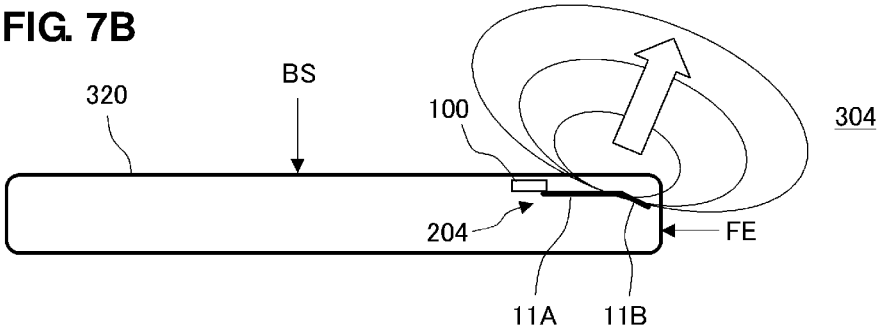
FIG. 7B is a front view that illustrates a state in which the antenna device 204 is incorporated in a communication terminal apparatus.

FIG. 7A is a perspective view of an antenna device 204 according to a fourth preferred embodiment. FIG. 7B is a front view that illustrates a state in which the antenna device 204 is incorporated in a communication terminal apparatus 304.

As illustrated in FIG. 7B, the antenna device 204 is arranged in a location adjacent to the front end FE in the terminal casing 320 of the communication terminal apparatus 304. Thus, when the front end FE of the communication terminal apparatus 304 is made to approach (is held over) a communication partner, such as an antenna of a reader-writer, stable communication can be carried out.

In the antenna device 204 according to the present preferred embodiment, the coil antenna 100 is arranged on an edge of a first planar conductor region 11A. The first planar conductor region 11A and a second planar conductor region 11B are disposed on the planes intersecting at a predetermined angle θ, respectively. In this case, the directivity of the antenna device 204 occurs in an intermediate direction between the direction of the normal to the first planar conductor region 11A and the direction of the normal to the second planar conductor region 11B, and the communication distance in this direction can be increased.

That is, as illustrated in FIG. 7B, the antenna device 204 is arranged such that the second planar conductor region 11B of the antenna device 204 is adjacent to the front end FE of the terminal casing 320 in the communication terminal apparatus. Thus, the antenna device 204 can have a high sensitivity in a range from the direction of the front end FE of the terminal casing 320 toward the direction of the back surface BS.

To prevent an increase in the loss of a current passing through each of the planar conductor regions 11A and 11B, the angle θ formed between the first planar conductor region 11A and the second planar conductor region 11B may preferably be larger than about 90° and smaller than about 135°, for example.

Fifth Preferred Embodiment

Figure 8A:
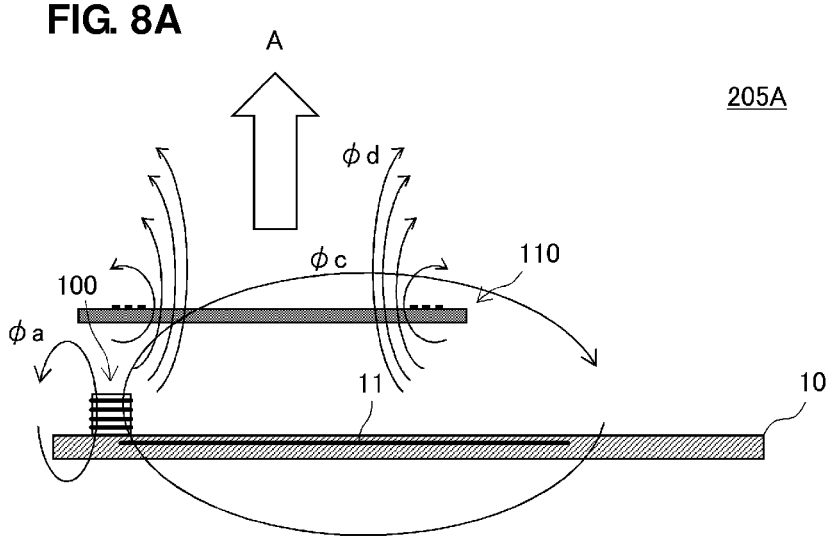
FIGS. 8A and 8B are front views of two antenna devices 205A and 205B according to a fifth preferred embodiment of the present invention, respectively.
Figure 8B:
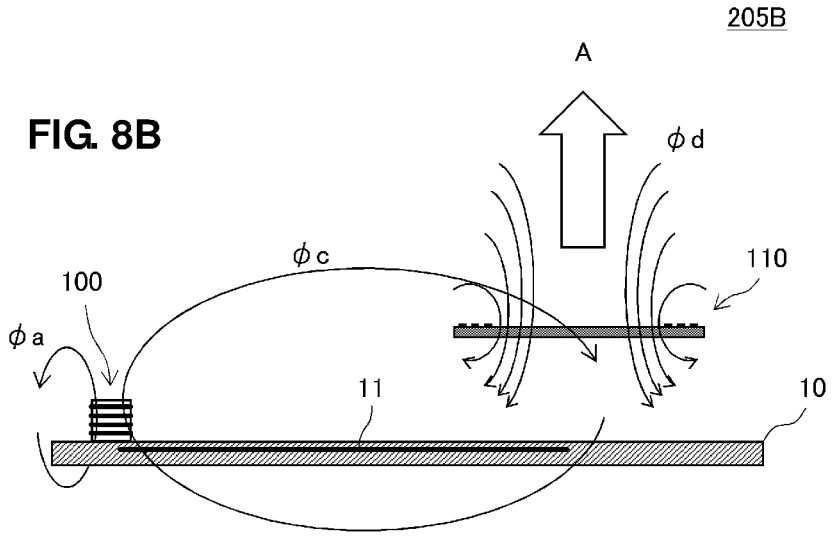

FIGS. 8A and 8B are front views of two antenna devices 205A and 205B according to a fifth preferred embodiment, respectively. Each of the antenna devices 205A and 205B according to the fifth preferred embodiment is the one in which the antenna device 201 illustrated in the first preferred embodiment further includes a resonant booster antenna 110. This resonant booster antenna corresponds to "planar coil antenna" according to a preferred embodiment of the present invention. The resonant booster antenna 110 is coupled to the coil antenna 100 through a magnetic field and acts as a booster antenna, and the detailed configuration of the resonant booster antenna 110 is described below. In the example illustrated in FIG. 8A, the resonant booster antenna 110 preferably is parallel or substantially parallel to the planar conductor 11 and is arranged in a location adjacent to the coil antenna 100 with respect to the center of the planar conductor 11. Thus, as illustrated in FIG. 8A, the resonant booster antenna 110 is coupled to the magnetic flux ϕc resulting from the coil antenna 100 through a magnetic field and acts as an antenna device having the directivity in the direction of the arrow A.

In the example illustrated in FIG. 8B, the resonant booster antenna 110 preferably is parallel or substantially parallel to the planar conductor 11 and is arranged in a location remote from the coil antenna 100 with respect to the center of the planar conductor 11. That is, the resonant booster antenna 110 is arranged in a location adjacent to a side of the planar conductor, the side being opposite to another side close to the coil antenna 100. Thus, as illustrated in FIG. 8B, the resonant booster antenna 110 is coupled to the magnetic flux ϕc resulting from the coil antenna 100 through a magnetic field and acts as an antenna device having the directivity in the direction of the arrow A.

Figure 9A:
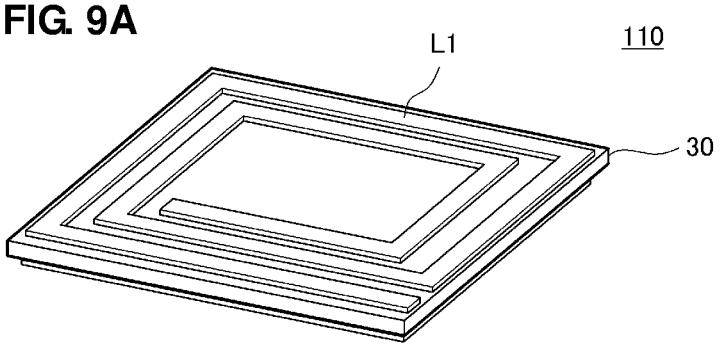
FIG. 9A is a perspective view of a resonant booster antenna 110.
Figure 9B:
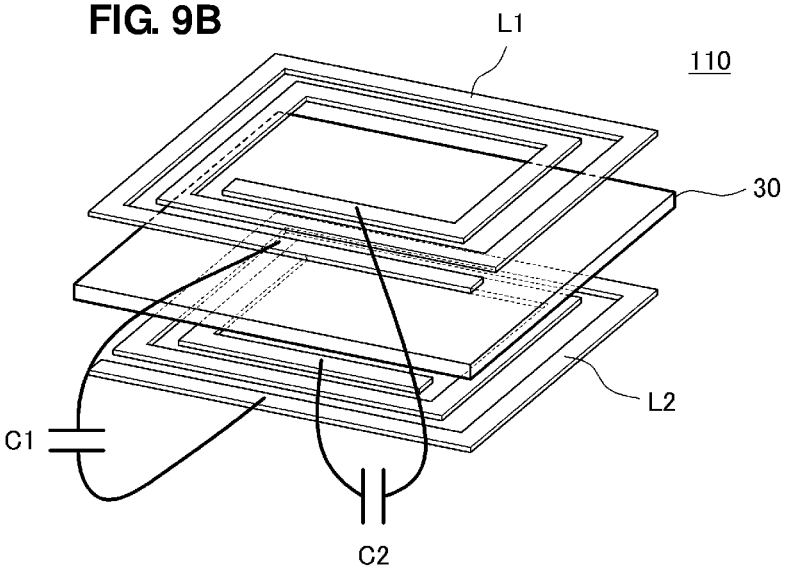
FIG. 9B is an exploded perspective view of the resonant booster antenna 110.
Figure 9C:
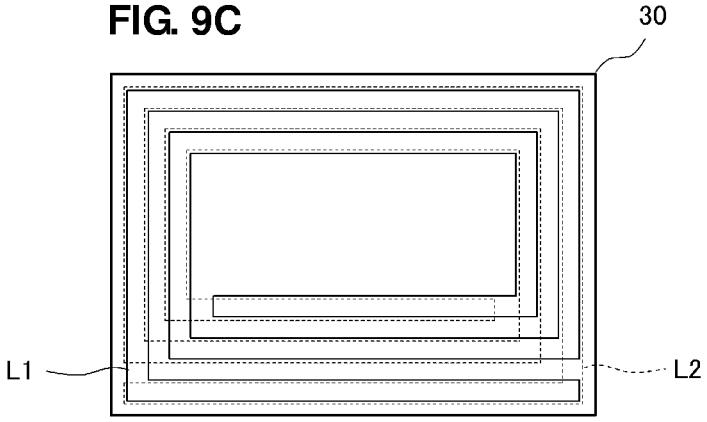
FIG. 9C is a plan view of the resonant booster antenna 110.

FIG. 9A is a perspective view of the resonant booster antenna 110, and FIG. 9B is an exploded perspective view of the resonant booster antenna 110. FIG. 9C is a plan view of the resonant booster antenna 110. The resonant booster antenna 110 includes a base 30 and rectangular or substantially rectangular spiral coil conductors L1 and L2 on the base 30. The rectangular or substantially rectangular spiral coil conductor L1 on the upper surface of the base 30 and the rectangular or substantially rectangular spiral coil L2 on the lower surface of the base 30 are arranged such that their coil conductors face each other and their winding directions are opposite (the same when seen in plan view in one direction).

Figure 10:
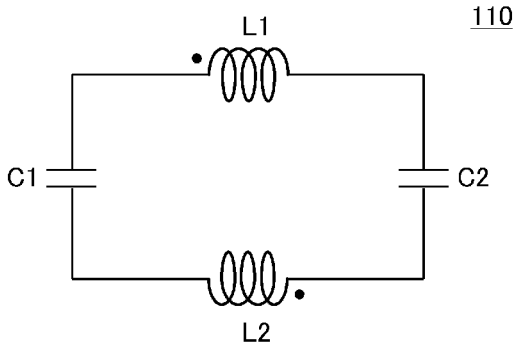
FIG. 10 is an equivalent circuit diagram of the resonant booster antenna 110.

FIG. 10 is an equivalent circuit diagram of the resonant booster antenna 110. In FIG. 10, the inductors L1 and L2 correspond to the above-described rectangular or substantially rectangular spiral coils L1 and L2. Because the rectangular or substantially rectangular spiral coils L1 and L2 face each other such that the base 30 is disposed therebetween, capacitances occur between them. The capacitances are indicated by capacitors C1 and C2 in FIG. 10. In such a way, the inductors L1 and L2 and the capacitors C1 and C2 enable the resonant booster antenna 110 to act as an LC resonant circuit. Its resonant frequency is the same as or near the carrier frequency of a communication signal.

As described above, providing the resonant booster antenna arranged so as to be close to the planar conductor enables the communication sensitivity in a desired direction to be improved using the resonant booster antenna, without the use of an additional conductive plate, irrespective of the mounting position of the coil antenna.

Sixth Preferred Embodiment

FIGS. 11A to 11D are front sectional views of four communication terminal apparatuses 306A, 306B, 306C, and 306D according to a sixth preferred embodiment, respectively. In these drawings, the main substrate 111, the coil antenna 100, the resonant booster antenna 110, and other elements are contained in the terminal casing 320 of each of the communication terminal apparatuses 306A, 306B, 306C, and 306D. The upper side of the terminal casing 320 in the drawings indicates the bottom of the terminal casing, and the lower side indicates the top (the surface where the display panel and the operating unit are disposed) of the terminal casing.

The planar conductor 11 as a ground conductor is disposed inside the main substrate 111. The coil antenna 100 and many other chip components are mounted on the main substrate 111. The coil antenna 100 is disposed such that a portion of the coil conductor and an edge of the planar conductor 11 overlap each other at least partially when seen in plan view in the direction of the winding axis. The resonant booster antenna 110 is attached to or arranged along the inner surface of the terminal casing 320. The resonant booster antenna 110 preferably is parallel or substantially parallel to the planar conductor 11 and is arranged in a location remote from the coil antenna 100 with respect to the center of the planar conductor 11.

Figure 11A:
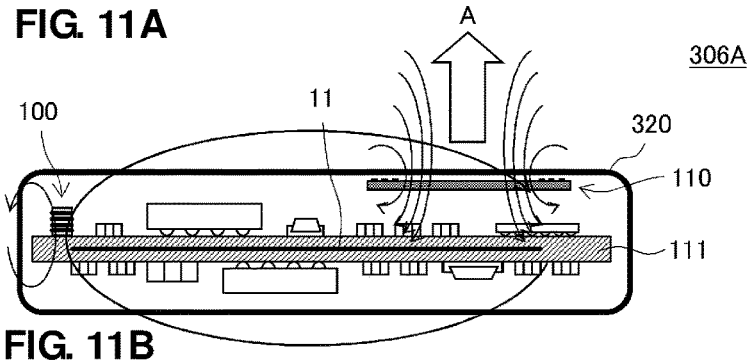
FIGS. 11A to 11D are front sectional views of four communication terminal apparatuses 306A, 306B, 306C, and 306D according to a sixth preferred embodiment of the present invention, respectively.

In the communication terminal apparatus 306A illustrated in FIG. 11A, the resonant booster antenna 110 is adjacent to the surface of the main substrate 111 on which the coil antenna 100 is mounted. In the communication terminal apparatus 306B illustrated in FIG. 11B, the resonant booster antenna 110 is adjacent to a surface that is opposite to the surface of the main substrate 111 on which the coil antenna 100 is mounted. In the communication terminal apparatus 306C illustrated in FIG. 11C, a resonant booster antenna 110F is adjacent to the surface of the main substrate 111 on which the coil antenna 100 is mounted, and a resonant booster antenna 110B is adjacent to a surface that is opposite to the surface of the main substrate 111 on which the coil antenna 100 is mounted. In the communication terminal apparatus 306D illustrated in FIG. 11D, the resonant booster antenna 110 is arranged along two surfaces (over the ridge) of the terminal casing 320.

In the communication terminal apparatus 306A illustrated in FIG. 11A, the planar conductor 11 acts as a radiator and the resonant booster antenna 110 also acts as a radiator. Because the resonant booster antenna 110 has a high directivity in the direction of the arrow A, the maximum distance for communication in the direction of the arrow A can be increased.

Figure 11B:
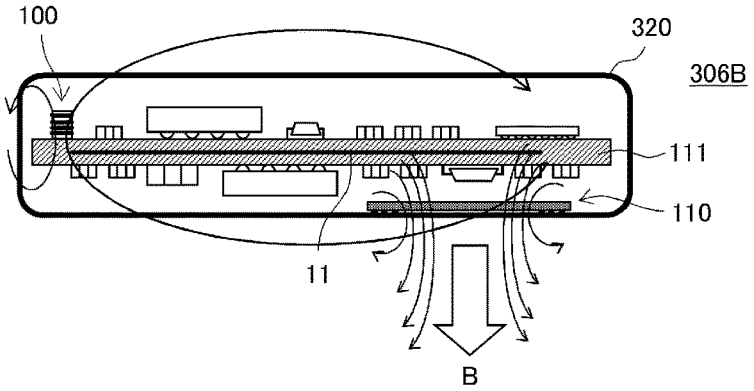

In the communication terminal apparatus 306B illustrated in FIG. 11B, because the resonant booster antenna 110 has a high directivity in the direction of the arrow B, the maximum distance for communication in the direction of the arrow B can be increased. Because the planar conductor 11 also acts as a radiator, a gain in the direction opposite to the direction of the arrow B can be ensured.

Figure 11C:
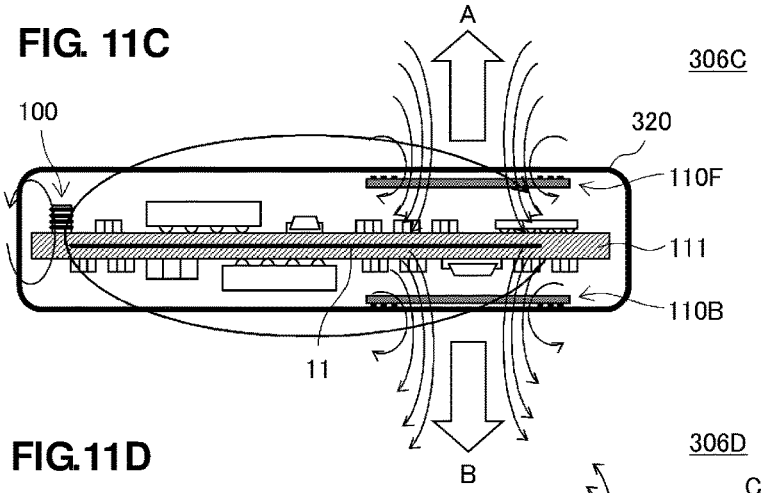

In the communication terminal apparatus 306C illustrated in FIG. 11C, the planar conductor 11 acts as a radiator and the resonant booster antennas 110F and 110B also act as radiators. Because the resonant booster antenna 110F has a high directivity in the direction of the arrow A and the resonant booster antenna 110B has a high directivity in the direction of the arrow B, the maximum distance for communication can be increased in both the directions of the arrows A and B.

Figure 11D:
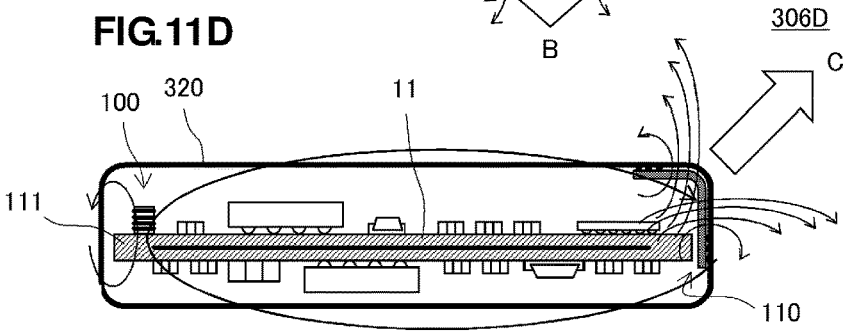

In the communication terminal apparatus 306D illustrated in FIG. 11D, the planar conductor 11 acts as a radiator and the resonant booster antenna 110 also acts as a radiator. Because the resonant booster antenna 110 has a high directivity in the direction of the arrow C (direction of 45 degrees), the maximum distance for communication in the direction of the arrow C can be increased.

Seventh Preferred Embodiment

Figure 12A:
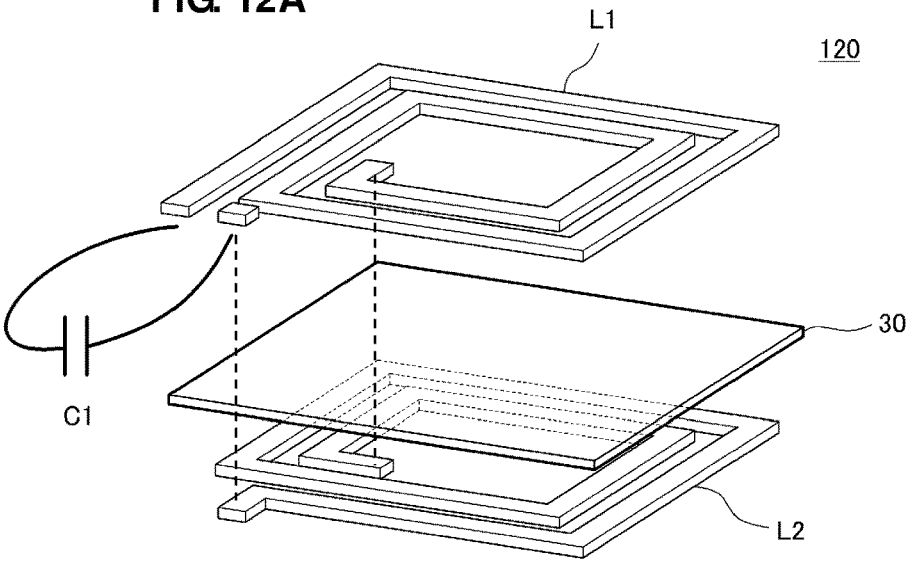
FIG. 12A is an exploded perspective view of a resonant booster antenna 120 according to a seventh preferred embodiment of the present invention.
Figure 12B:
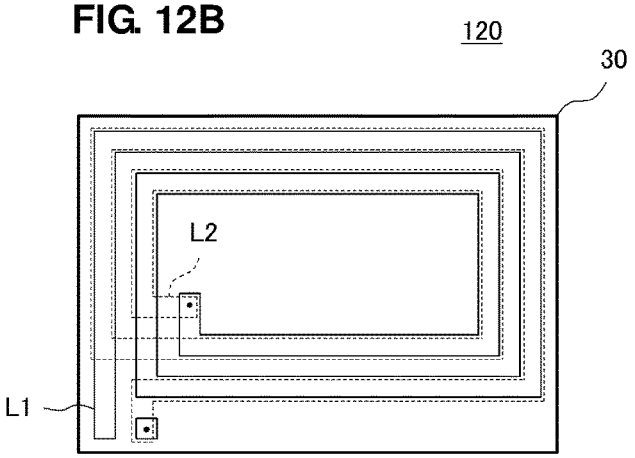
FIG. 12B is a plan view of the resonant booster antenna 120.
Figure 13:
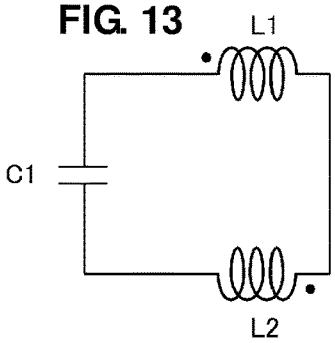
FIG. 13 is an equivalent circuit diagram of the resonant booster antenna 120.

Another example of the resonant booster antenna is described in a seventh preferred embodiment. FIG. 12A is an exploded perspective view of a resonant booster antenna 120 according to the seventh preferred embodiment. FIG. 12B is a plan view of the resonant booster antenna 120. FIG. 13 is an equivalent circuit diagram of the resonant booster antenna 120.

The resonant booster antenna 120 includes the base 30 and the rectangular or substantially rectangular spiral coil conductors L1 and L2 on the base 30. The rectangular or substantially rectangular spiral coil conductor L1 on the upper surface of the base 30 and the rectangular or substantially rectangular spiral coil conductor L2 on the lower surface of the base 30 are arranged such that their coil conductors face each other and their winding directions are opposite (the same when seen in plan view in one direction). The inner end of the coil conductor L1 is electrically connected to the inner end of the coil conductor L2 with a via conductor disposed therebetween. The capacitor C1 outside the illustration is connected between the outer end of the coil conductor L1 and the outer end of the coil conductor L2.

As illustrated in FIG. 13, the inductors L1 and L2 and the capacitor C1 enable the resonant booster antenna 120 to act as an LC resonant circuit. Its resonant frequency is the same as or near the carrier frequency of a communication signal.

Other Preferred Embodiments

In the above preferred embodiments, examples in which the planar conductor 11 preferably is exposed to the exterior of the base 10 are described. Alternatively, the planar conductor 11 may be disposed inside a printed wiring board, for example.

Of the coil conductor (21, which is the corresponding reference numeral in the first preferred embodiment; the same applies to the following), the winding axis may not be perpendicular or substantially perpendicular to the planar conductor (11). It is sufficient that the coil antenna (100) be mounted such that the mounting surface is the conductor aperture plane AP, which is a plane through which the winding axis of the coil conductor (21) passes, and that the booster antenna including the planar conductor (11) and the coil antenna (100) be coupled together through an electromagnetic field. In particular, when the winding axis of the coil conductor (21) is in a perpendicular or substantially perpendicular relation to the plane of the planar conductor (11), the magnetic flux resulting from the current passing through the coil conductor (21) of the coil antenna (100) and the magnetic flux resulting from the current passing through the planar conductor (11) are in the same direction, the directivity of the antenna device (201) can be increased. Typically, when the angle between the winding axis of the coil conductor (21) and the normal of the planar conductor (11) is in the range of about ±45 degrees, for example, satisfactory directivity and gain are obtainable.

The antenna device according to various preferred embodiments of the present invention is not limited to an antenna device for use in the HF range and is also applicable to an antenna device for use in other frequency bands, such as the low frequency (LF) range or the ultrahigh frequency (UHF) range.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A communication terminal apparatus comprising:

an antenna device that includes a coil antenna, a planar conductor, and a magnetic material, the coil antenna being a chip coil antenna and including a coil conductor wound around a winding axis and a coil opening through which the winding axis passes, the planar conductor is coupled to the coil antenna through an electromagnetic field, and the magnetic material is arranged between the planar conductor and all portions of the coil conductor; and a communication circuit connected to the antenna device; wherein the coil antenna partially overlaps with the planar conductor;

at least a portion of the coil opening does not overlap with the planar conductor;

the winding axis is perpendicular to a plane of the planar conductor or an angle between the winding axis and a normal of the planar conductor is in a range of ±45 degrees; and the planar conductor is made of a non-magnetic material and is a ground conductor of a main substrate on which the coil antenna is mounted.

2. The communication terminal apparatus according to claim 1, further comprising:

an elongated casing that houses the communication circuit, wherein the antenna device is arranged such that the planar conductor is adjacent to an end of the casing.

3. The communication terminal apparatus according to claim 2, wherein the coil antenna is provided between the planar conductor and the end of the casing.

4. The antenna device according to claim 1, wherein the coil conductor is arranged outside of the magnetic material.

5. The communication terminal apparatus according to claim 1, wherein the coil conductor is arranged outside of the magnetic material.

* * * * *